US006349429B1

(12) United States Patent
Zurba et al.

(10) Patent No.: US 6,349,429 B1
(45) Date of Patent: Feb. 26, 2002

(54) APERTURED COUNTERTOP MOUNTING UNIT

(75) Inventors: Peter Zurba, Burnaby; Bryan Gordon Drozdowich, Clearbrook, both of (CA)

(73) Assignee: Counter-Mate, Inc. (BB)

( * ) Notice: Subject to any disclaimer, the term of this patent is extended or adjusted under 35 U.S.C. 154(b) by 0 days.

(21) Appl. No.: 09/544,880

(22) Filed: Apr. 7, 2000

Related U.S. Application Data

(60) Division of application No. 09/074,930, filed on May 7, 1998, which is a continuation-in-part of application No. 08/601,295, filed on Feb. 16, 1996, which is a continuation-in-part of application No. PCT/CA95/20482, filed on Aug. 17, 1995, now abandoned, which is a continuation-in-part of application No. 08/291,663, filed on Aug. 17, 1994, now Pat. No. 5,551,103.

(51) Int. Cl.[7] ..... A47K 1/00; E03C 1/33
(52) U.S. Cl. ..... 4/661; 4/631
(58) Field of Search ..... 4/631–635, 660, 4/661

(56) References Cited

U.S. PATENT DOCUMENTS

| | | | |
|---|---|---|---|
| 4,374,695 | A | 2/1983 | Ikeda et al. |
| 5,016,297 | A | 5/1991 | Sauter et al. |
| 5,551,103 | A | 9/1996 | Drozdowich et al. |
| 5,754,991 | A | 5/1998 | Drozdowich et al. |

FOREIGN PATENT DOCUMENTS

| | | |
|---|---|---|
| DE | 2917144 | 11/1980 |
| DE | 3420532 | 12/1985 |
| DE | 4041586 | 10/1991 |
| GB | 2224648 | 5/1990 |
| GB | 2242626 | 10/1991 |
| JP | 159932 | 12/1980 |

*Primary Examiner*—Charles E. Phillips
(74) *Attorney, Agent, or Firm*—TraskBritt

(57) ABSTRACT

An apertured mounting unit comprises a deck sheet with a top and a bottom surface, the deck sheet has a cross-sectional edge defining an aperture. A non-porous seal member abuts the edge, the seal member has top and bottom surfaces. A sink with an upper circumferential flange may be removably mounted on the bottom surface of the deck sheet, with the flange in sealing engagement with the seal member. The flange cooperates with the seal member and with the bottom surface of the deck sheet so that the flange is brought into sealable engagement with the seal member when the flange is biased against a stop that is fixed with respect to the bottom surface of the deck sheet.

22 Claims, 9 Drawing Sheets

APERTURED COUNTERTOP MOUNTING UNIT

This application is a divisional of U.S. application Ser. No. 09/074,930, filed May 7, 1998, which is a continuation-in-part of U.S. application Ser. No. 08/601,295, filed Feb. 16, 1996; issued as U.S. Pat. No. 5,754,991 on May 26, 1998 that application was a continuation-in-part of International Application No. PCT/CA95/00482, which designated the U.S., with an international filing date of Aug. 17, 1995, now abandoned; that International Application was a continuation-in-part of U.S. application Ser. No. 08/291,663, filed Aug. 17, 1994, which issued Sep. 3, 1996 as U.S. Pat. No. 5,551,103.

FIELD OF THE INVENTION

The invention is in the field of countertop mounting units, such as sink mounts. More particularly, the invention relates to sealing means associated with sink mounts and the like.

BACKGROUND OF THE INVENTION

Laminated countertops are typically constructed with a thin surface layer of plastic laminate (such as FORMICA™ brand laminate from the Formica Corporation, Cincinnati, Ohio). The laminate is generally made up of layers of colored paper impregnated with polymeric resin and pressed into sheet stock. The surface laminate is typically bonded to a wood fibre core, such as plywood, particle board or flake board. The laminate serves, among other things, to seal the surface of the countertop against liquids. Similarly, porous countertops may be covered with tiles, typically made from ceramic materials, to form a surface seal.

To mount a sink in a laminated or tile countertop, a cross-sectional hole is typically cut through the porous core. The core, such as wood fibre, exposed by the cross-sectional cut in the countertop is generally porous. A seal must be used to exclude water from the unlaminated, cut edge of the countertop. Typically, this is achieved by dropping a sink with an upper circumferential flange into the mounting aperture from above. In some cases, steps may be taken to seal the flange against the laminated or tiled countertop. In the case of a tile countertop, the top of which may be uneven, it may be particularly difficult to form such a seal.

The traditional method of mounting flanged drop-in sinks gives rise to a number of problems. For example, it is not convenient to run cleaning solution over the flange, since the cleaner would not run back into the sink but out over the countertop. Wiping the countertop next to the flange tends to have the effect of forcing water, dirt and debris under the flange.

If the seal between the sink flange of a drop-in sink and the countertop laminate or tile deteriorates, water can leak down into the exposed porous wood fibre edge of the countertop core. The positioning of the flange above the wood fibre edge facilitates this undesirable downward flow into the core. Eventually, the countertop may suffer structural failure as the wetted core first swells, then looses its structural integrity altogether. Even before the fibre core fails, however, the area beneath a leaking sink flange may become an unsanitary habitat for the proliferation of micro-organisms.

Solid countertops, made of natural materials such as stone, are a generally a more expensive alternative to laminated countertops. Synthetic polymer based 'solid surface' materials have been developed as an alternative to natural solid surface countertop materials. For example, E.I. du Pant de Nemours and Company sell an alumina trihydrate filled methylmethacrylate polymer solid surface countertop material, marketed under the trade-mark CORIAN™. Similar polymer based synthetic products are also available from others, such as AVONITE™ (by Avonite, Inc., Belen, N. Mex.), FOUNTAINHEAD™ (by the Nevamar Division of International Paper, Odenton, Md. a homogeneous, thermoses polymer alloy, comprised of polyester and acrylic components and filled with aluminum trihydrate), SURELL™ (by Wilden Industries, Inc.) and GIBRALTAR™ (an acrylic resin with fire-retardant mineral fillers, by Wilsonart International, Temple, Tex.). These solid surface materials generally have high temperature resistance, low thermal expansion, low water absorption (they are non-porous) and are hard and impact resistant.

Polymer based solid surface materials are generally available as sheet stock in an appropriate thickness for use as countertop material, such as ¼ inch ½ inch or ¾ inch thicknesses. Alternatively, thinner solid surface materials may be available as a laminated layer on a substrate such as plywood or particleboard (such as ⅛ inch Solid Surfacing Veneer 'SSV' product available from Wilsonart International, Temple, Tex.).

The widespread market acceptance of novel solid surface materials has led in turn to new developments in kitchen and bathroom fixtures. Unlike laminated countertops, solid surface countertops lack a porous wettable core. As a result, a sink may be mounted to the underside of an aperture cut in a solid surface countertop, and the non-porous crosssectional edge of the countertop left exposed without risk of damage to the countertop. To take advantage of this feature, a wide range of sinks are available that have been adapted for installation below countertop surfaces. These 'undermount' sinks generally include an upper peripheral flange adapted to seal against the underside of a solid surface countertop. Undermount sinks may be made out of a wide variety of materials, including natural stone, polymer based solid surface materials and stainless steel (which may be available for example from Kindred Industries of Midland Ontario, Canada).

At least in part because of the problems inherent in the typical method of top-mounting drop-in sinks, undermount sinks have gained widespread acceptance for use with solid surface countertops. However, solid surface countertops remain significantly more expensive than laminated countertops. It is therefore an object of the present invention to facilitate the use of undermount sinks with laminated countertops, including countertops laminated with polymeric solid surface materials, as well as tiled countertops.

SUMMARY OF THE INVENTION

In one aspect, the invention provides an apertured mounting unit comprising a deck sheet with a top surface and a bottom surface. The deck sheet may have a porous cross-sectional edge defining an aperture. Such an aperture may be of any shape and may be completely defined by surrounding deck sheet, or may be a partial cut-out in the deck sheet, such as a semi-circular cut-out in one side of the deck sheet.

A non-porous seal member is provided to facilitate sealing of the cross-sectional edge. As used herein, a nonporous material is defined as a material that is generally resistant to the passage of fluids, especially water, while porous materials do not form an adequate fluid barrier. It will be appreciated that these are relative terms, reflecting a difference in the porosity of the seal member and the deck sheet.

The outer peripheral surface of the seal member may be positioned to abut the cross-sectional edge. The inner peripheral surface of the seal member accordingly defines an opening.

A utility member, such as a sink, may be provided for mounting to the apertured mounting unit. The utility member may have a circumferential outwardly extending flange. This flange need not extend from the whole circumference of the utility member. The utility member is adapted for sealing engagement with the bottom surface of the seal member and adapted to abut a stopping surface fixed with respect to the bottom surface of the deck sheet. The utility member may be supported, or depend, from a bottom surface of the deck sheet.

A fastener or other means are provided for removably supporting the utility member from the bottom surface of the deck sheet. The removability of the utility member may be desirable, for example, to facilitate replacement of a damaged sink. Such removal of the utility member may necessitate careful removal of any adhesive, such as cured silicone, holding the utility member to the ring. The means for removably holding the utility member includes adhesives, clamps or other biasing means, as well as combinations and equivalents thereof. A wide variety of fasteners and means for holding may be utilized, such as those that are known in the art of sink undermounting, including nails, screws, nuts with bolts and specialized sink-mounting clamps, all of which may be used for the present invention provided they are capable of removably supporting the utility member on the bottom of the deck sheet.

The fasteners or means for holding the utility member may be used to apply a biasing force to bias the circumferential outwardly extending flange of the utility member towards the bottom surface of the deck sheet, and against the stopping surface and, simultaneously, into sealable engagement with the bottom surface of the seal member. The engagement between the flange and the ring is 'sealable' in some embodiments, rather than sealed, in as much as the parts are juxtaposed but forming a liquid-tight seal may require the additional use of an adhesive, gasket, packing, spacer or equivalent structures between the flange and the ring.

In some embodiments, the stopping surface engages the flange to communicate the biasing force to the bottom surface of the deck sheet. This may help to prevent undue upward biasing force from being transmitted to the seal member.

The stopping surface may be the bottom surface of the deck sheet. Alternatively, the stopping surface may be the bottom surface of the seal member, with a portion of the seal member abutting the bottom surface of the deck sheet. The seal member may comprise a horizontal portion that extends below the deck sheet. A top surface of the horizontal portion may abut the bottom surface of the deck sheet.

In a further alternative, the cross-sectional edge and seal member may be matingly profiled so that in the profiled portion of the cross-sectional edge an upper segment of the cross-sectional edge projects further into the aperture than a lower segment of the cross-sectional edge. The profiled portion of the cross-sectional edge restricts the upward movement of the seal member with respect to the deck sheet. Any biasing force applied to the seal member is transmitted to the bevelled cross-sectional edge of the deck sheet.

A clamp may be used to fasten the utility member to the deck sheet. Such a clamp may be adapted for threadably biasing a clamping member against the flange. The clamp may comprise a threaded member depending downwardly from a bore in the deck sheet, the bore and the threaded member being sized to prevent the threaded member from moving downwardly in the deck sheet, the threaded member being adapted to threadably receive a nut to retain a clamp member for applying the biasing force.

In one embodiment, a generally planar portion of the bottom surface of the seal member may be substantially coplanar with an adjacent generally planar portion of the bottom surface of the deck sheet. In such an embodiment, the flange may be adapted to sealably engage the generally planar portion of the bottom surface of the seal member and to abut the generally planar portion of the bottom surface of the deck sheet. The generally planar portion of the bottom surface of the deck sheet may thereby comprise the stopping surface against which the flange is biased.

The seal member may comprise a solid surface material selected from the group of polyester resins; acrylic resins; cast acrylic resins with inert fillers, mineral filled polyester resins; mineral filled acrylic resins; methylmethacrylate polymers with alumina trihydrate fillers; and, homogeneous, thermoses polymer alloys comprised of polyester and acrylic components and filled with aluminium trihydrate. Equivalent compositions known to those skilled in this art may also be used.

A generally planar portion of the top surface of the deck sheet and a generally planar portion of the top surface of the seal member may be generally coplanar. A countertop material, such as traditional paper laminate, SSV laminate, tile or equivalents thereof, may be bonded to the generally planar portion of the top surface of the deck sheet-in sealing engagement with the generally planar portion of the top surface of the seal member.

In another aspect, the invention provides a method of manufacturing an apertured mounting unit comprising the steps, not necessarily is sequential order, of:

1) providing a porous deck sheet having a top surface and a bottom surface;
2) cutting the deck sheet to form a porous crosssectional edge in the deck sheet defining an aperture;
3) forming a non-porous seal member having a top surface and a bottom surface, the seal member being dimensioned to fit inside the aperture and abut the crosssectional edge of the deck sheet; and,
4) inserting the seal member into the aperture in abutment with the cross-sectional edge of the deck sheet.

Additional steps may include:

5) providing a utility member with an outwardly extending circumferential flange; and,
6) removably fastening the utility member to the deck sheet by applying a biasing force to bias the upper circumferential flange of the utility member into sealable engagement with the bottom surface of the seal member as the upper circumferential flange is biased against a stopping surface that is fixed with respect to the bottom surface of the deck sheet, the stopping surface communicating the biasing force to the bottom surface of the deck sheet.

In another aspect, the invention provides an apertured mounting unit comprising a deck sheet with a top and a bottom surface. An aperture is cut in the deck sheet, so that the deck sheet has a cross-sectional edge that defines the aperture. The edge of the deck sheet exposed in cross-section is generally porous (relative, for example, to the surface of a laminated or tile countertop). This is the case, if, for example, the deck sheet core is comprised of plywood, particle board or flake board. A non-porous, and preferably rigid, seal member, such as a ring, abuts up against, and may be glued to, the cross-sectional deck sheet edge. The seal member, like the deck sheet, has top and bottom surfaces.

In some embodiments, the top and bottom surfaces of the seal member adjacent to the edge of the deck sheet may be coplanar with the top and bottom surfaces of the deck sheet. In such embodiments, 1/16 inch to 3/4 inch of the bottom surface of the seal member adjacent to the crosssectional edge may be coplanar with the adjacent bottom surface of the deck sheet, so that an undermount sink (or other utility member) may be sealably mounted against the bottom surface of the seal member. In some embodiments, sealing engagement between the sink flange and the seal member may be facilitated if the bottom planar surface of the seal member is at least 1/4 inch wide. If the top surface of the seal member is coplanar with the top surface of the deck sheet, a countertop laminate may be sealed across the top surface of the seal member and the top surface of the deck sheet. Any appropriately flanged appliance or fixture may be attached as a utility member to the underside of the countertop in sealing abutment with the bottom surface of the seal member.

To manufacture the apertured mounting unit according to one embodiment of the invention, a deck sheet is provided. The deck sheet has top and bottom surfaces. An aperture is cut in the deck sheet, to form a crosssectional edge on the deck sheet defining the aperture. The cross-sectional cut in the deck sheet exposes the porous core of the deck sheet. A seal member, preferably rigid, having top and bottom surfaces, is formed. The seal member is dimensioned to fit inside the aperture and abut the edge of the deck sheet. The seal member is inserted into the aperture in abutment with the cross-sectional edge of the deck sheet. The top and bottom surfaces of the seal member adjacent to the edge may be coplanar with the adjacent top and bottom surfaces of the deck sheet. The top surface of the deck sheet and the seal member may be covered with a layer of laminate, sealing over the top of the joint between the seal member and the deck sheet.

In one embodiment, the seal member is formed by cutting at least two strips of appropriately dimensioned seal member material from seal member sheet stock. The strips of seal member material are then heated to a temperature at which the strips are deformable. The strips may then be molded, each to an appropriate shape to fit against a portion of the deck sheet edge. The strips may then be bonded together to form a complete seal member in the shape of a ring (a seal ring). A groove may then be cut in the bottom surface of the seal ring, into which a gasket may be sealably seated. Alternatively, the gasket material may be applied to the seal ring as a bead of hardenable liquid. The gasket material may be a resilient polymer based material, or any other suitable water-resistant, preferably deformable, compound capable of mediating sealing engagement between the seal member that a utility member flange.

The ready-made combination of deck sheet and seal member may be conveniently shipped to consumers for final installation as a mounting unit. In an alternative embodiment, utility member may be installed on deck sheet with seal member prior to shipment of the assembled article to consumers. An appropriately dimensioned laminated mounting unit may be fitted as one piece of a modular countertop, using standard countertop assembly methods. If the mounting unit is not laminated, final installation may be accomplished by joining the mounting unit to the remainder of a countertop core, the top and bottom surfaces of the mounting unit being aligned respectively with the top and bottom surfaces of the countertop core. Then, the top surface of the countertop, including the deck sheet and the top surface of the seal member may be laminated. Once bonded, the countertop laminate layer seals against the top surface of the seal member and deck sheet, to provide a countertop liquid barrier to keep water and other liquids away from the porous cross-sectioned core of the countertop exposed at the edge of the deck sheet. Excess laminate sheet may be trimmed from the countertop surface. As part of the trimming process, the solid surface ring seal material may be sanded or routed to an aesthetic and functional finished shape.

Once the mounting unit is in place in a countertop, an undermount sink, or other fixture, may be affixed to the bottom surface of the mounting unit. To seal the upper peripheral sink flange to the bottom surface of the seal member, a bead of appropriate liquid sealant, such as silicone adhesive or equivalents thereof, may be applied to the bottom surface of the seal member before the sink flange is clamped to the bottom surface of the mounting unit. In addition, a gasket may be used to help seal the sink flange to the seal member. The gasket may be seated in, and protrude downwardly from, a channel in the bottom surface of the seal member. Alternatively, the gasket may be applied to the planar bottom surface of the ring. When the sink is in place, the gasket may sealingly abut the sink flange. The gasket may be made of a resilient polymer based material, such as silicone rubber, or any other water resistant material, preferably deformable, that is capable of mediating sealing engagement between the seal member and the utility member flange. The seal between a sink flange and the bottom surface of the seal member provides a counter-bottom liquid barrier to keep water and other liquids away from the porous cross-sectioned core of the deck sheet.

When the seal member is installed between a layer of countertop laminate and an undermount sink flange, it acts as a gasket, sealing the space between the countertop laminate and the undermount sink flange. The seal member thereby isolates the relatively porous cross-sectioned core of the deck sheet from any liquid. A further barrier is provided by the abutment of the seal member itself against the cross-sectional edge of the deck sheet. The seal member may be glued to the cross-sectional edge, the adhesive providing a further barrier to keep liquid away from the porous core of the deck sheet.

Although the deck sheet may be comprised of wood fibre material such as plywood, particle board or flake board, the deck sheet may be made of a dense water-resistant board, such as MEDITE™ or MEDIX™ brand board (manufactured by the Medite Corporation, Medford, Oreg.). The use of such board further reduces the risk of water damage to the cross-sectioned edge of the deck sheet. In alternative embodiments, the deck sheet may be fashioned out of a wide variety of porous materials in addition to cellulose based materials, such as plaster board.

The thickness of the deck sheet may be tailored to match the standard thickness of laminated countertop core materials in common use. In many areas of North America, for example, this will correspond to 5/8 inch board. Similarly, the deck sheet may be cut to overall dimensions that facilitate installation of the mounting unit with standard laminated countertops, 27 inches wide by 49 inches long being one preferred size in North America.

The seal member may be made of molded plastic, such as cured polyester or acrylic resin based plastics. The plastic may be comprised of solid surface countertop material, such as CORIAN™ brand sheet from the Dupont Company (methylmethacrylate polymer and alumina trihydrate filler) or FOUNTAINHEAD™ brand solid surface material (homogeneous, thermoses polymer alloy, comprised of polyester and acrylic components and filled with aluminum trihydrate).

A wide variety of solid surface countertop materials are available in standard sheet forms of varying thickness. To produce the seal member of the invention, appropriate solid surface sheet material may be cut into appropriately dimensioned strips which are then heat formed to an appropriate shape. The temperature and duration of heat forming will vary with the material used. 315° Fahrenheit (F.)–330° F. is in some embodiments appropriate for CORIAN™ brand material, while 260° F.–290° F. may be suitable in some embodiments for polyester resin based materials such as CAROTENE™, AVONITE™, FOUNTAINEAD™, SURELL™ or GIBRALTAR™. The duration of heating will also vary with material size and composition, 15 to 20 minutes being suitable for some ⅝"×½" strips of CORIAN™ brand material. Those skilled in the art will appreciate that variations in these specifications are appropriate in some circumstances, to produce the desired deformation of the solid surface material.

It is also be possible to injection mold appropriate seal members in a unitary form. Alternatively, material may be extruded into strips that can be cut, bent and joined to form appropriate seal members. In some embodiments, the outer peripheral surface of the ring may have protrusions or indentations that mate with corresponding indentations or protrusions on the cross-sectional edge of the deck sheet.

The cross-sectional edge of the deck sheet may be beveled inwardly from the top surface of the deck sheet to the bottom surface, so that the top of the edge projects further into the aperture than the bottom of the edge. In this embodiment, the seal member has a corresponding bevel, which may, for example, be 3 degrees from vertical.

A method of manufacturing an apertured mounting unit in accordance with the invention may comprise the steps of:

providing a deck sheet having a top surface and a planar bottom surface;

cutting an aperture in the deck sheet, to form a cross-sectional edge in the deck sheet defining the aperture;

forming a non-porous seal member having a top surface and a planar bottom surface, the seal member being dimensioned to fit inside the aperture and abut the edge of the deck sheet; and, inserting the seal member into the aperture in abutment with the cross-sectional edge of the deck sheet, so that the planar bottom surface of the seal member is coplanar with the planar bottom surface of the deck sheet.

A method of forming the seal member may further comprise of the steps of:

providing at least two strips of appropriately dimensioned seal member material selected from the group consisting of polyester resins; acrylic resins; cast acryl resins with inert filler; mineral filled polyester resins; mineral filled acrylic resins; methylmethacrylate polymers with alumina trihydrate fillers; thermoses polymer alloys comprised of polyester and acrylic components and filled with aluminum trihydrate;

heating the strips of seal member material to a temperature at which the strips are deformable;

molding the heated strips to an appropriate shape to fit against a portion of the deck sheet edge; and bonding the strips of seal member material together to form the seal member.

The method of forming the seal member may further comprise the step of providing a resilient gasket on the bottom surface of the seal member.

A method of installing the apertured mounting of the invention may comprise the steps of:

providing an apertured mounting unit comprising:

a deck sheet with a top and a bottom surface, the deck sheet having a cross-sectional edge defining an aperture;

a non-porous seal member abutting the edge, the seal member having top and bottom surfaces, the top and bottom surfaces of the seal member adjacent to the edge being generally flush with adjacent top and bottom surfaces of the deck sheet; and the a top surface of the mounting unit comprised of the top surfaces of the sheet deck and the seal member, and a bottom surface comprised of the bottom surfaces of the sheet deck and the seal member;

providing a countertop core having top and bottom surfaces;

joining the apertured mounting unit to the countertop core, the top and bottom surfaces of the mounting unit being aligned respectively with the top and bottom surfaces of the countertop core;

bonding a laminate sheet to the top surfaces of the countertop core and the mounting unit, to provide a countertop surface seal spanning the junctions between the seal member, deck sheet and countertop core;

trimming excess laminate sheet from the countertop surface;

providing a utility member with a flange adapted for under-mounting to a countertop aperture;

sealingly affixing the flange of the utility member to the bottom surface of the seal member.

DETAILED DESCRIPTION

Figure 1:
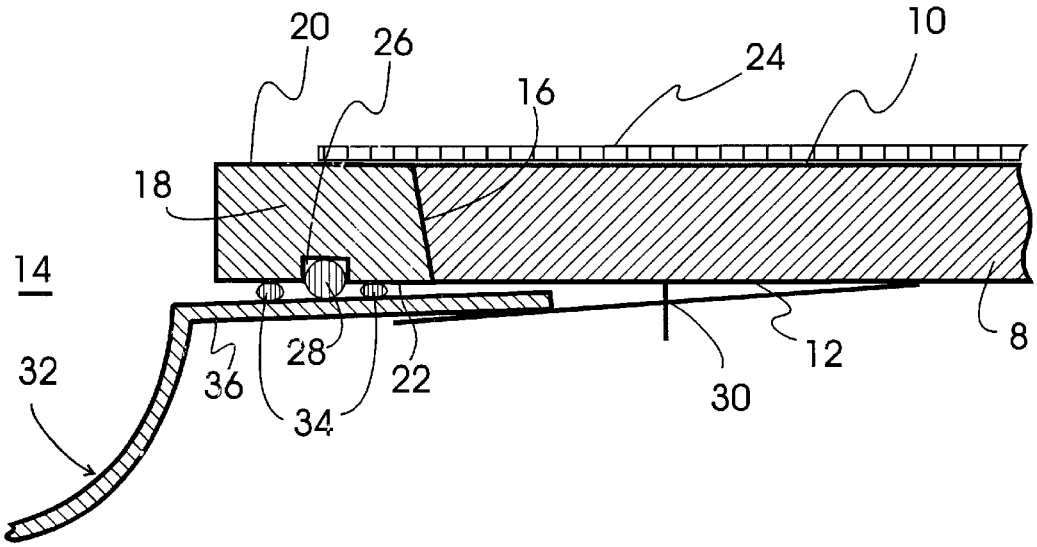
FIG. 1 is an partially fragmented, partially exploded, cross-sectional view of a mounting unit showing an undermount sink and laminated countertop, in which the sink is being biased towards the deck.

As shown in FIGS. 1–4, apertured mounting unit 6 comprises deck sheet 8 and seal member 18. Deck sheet 8 may be made of dense water-resistant board (such as MEDIX™ brand) and may have a planar top surface 10 and a planar bottom surface 12. The entire top and bottom surfaces of deck sheet 8 need not be planar. In general, when a part is described herein as having a top or bottom planar surface, it will be understood that this does not dictate that all of the top or bottom surfaces of such a part are planar, merely that a portion of the surface is substantially planar. In functional terms, planar surfaces of the invention are surfaces of which an adequate portion lies on the same general plane to allow those surfaces to mate with another generally planar surface. Accordingly, planar surfaces of the invention may have some undulations or irregularities.

Figure 2:
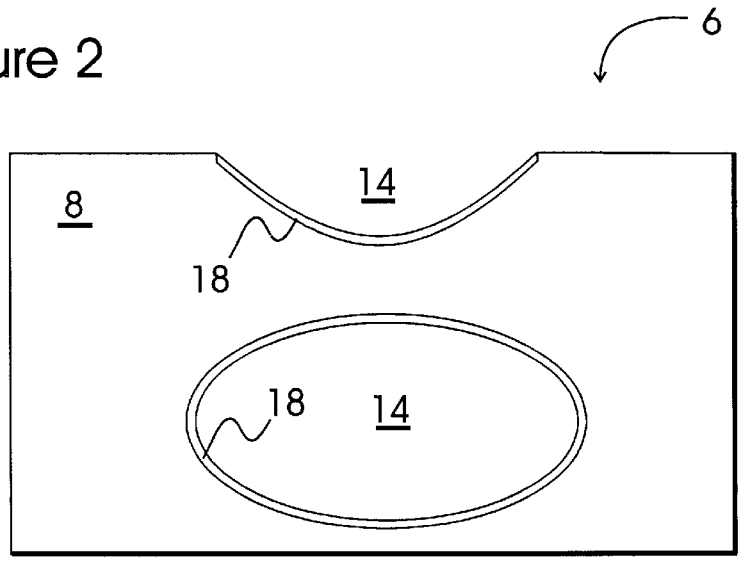
FIG. 2 is a plan view of an apertured mounting unit, showing two embodiments of seal members in apertures defined by the deck sheet.
Figure 3:
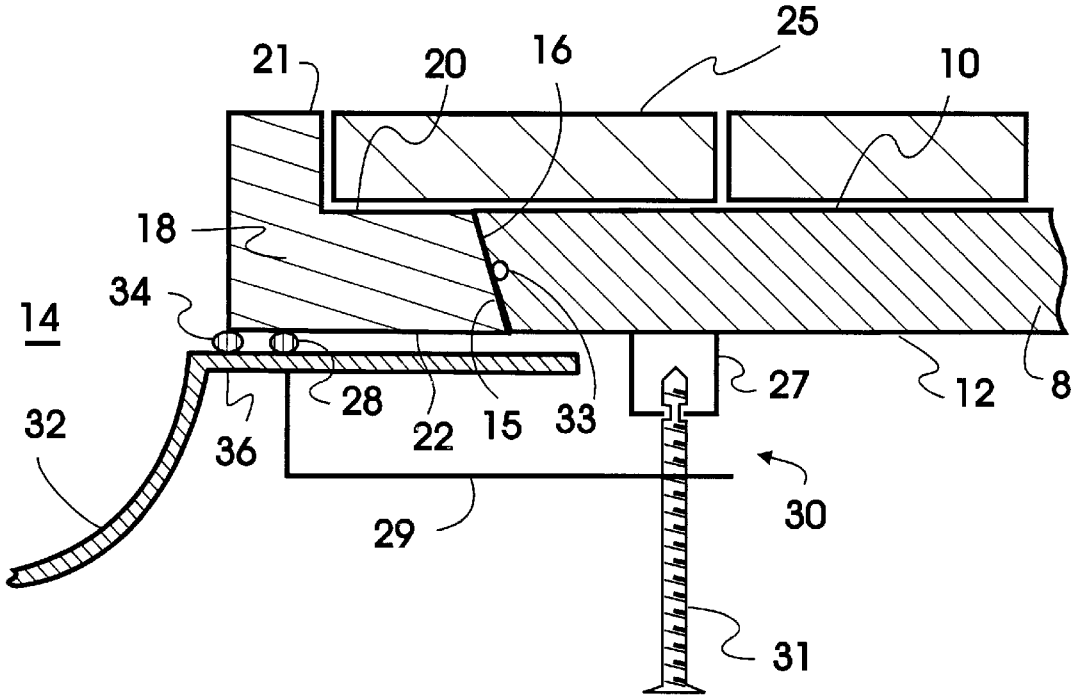
FIG. 3 is a partially fragmented, partially exploded, cross-sectional view of the mounting unit, showing an undermount sink and tile countertop, in which the sink is being biased towards the deck.

Cross-sectional edge 16 of deck sheet 8 defines aperture 14. As shown in FIG. 2, the aperture 14 may be defined entirely by deck sheet 8, or aperture may be a partial cut-out on an edge of deck sheet 8. At least a portion of cross-sectional edge 16 may be bevelled inwardly from the top surface of deck sheet 8 to the bottom surface, so that in the bevelled portion of cross-sectional edge 16, an upper segment of edge 16 projects further into aperture 14 than a lower segment of edge 16. Such bevelling may act to restrict the upward movement of seal member 18 with respect to deck sheet 8. As shown in FIGS. 1 and 3, the bevelled portion of cross-sectional edge 16 may be generally straight in vertical cross section and may meet planar bottom surface 12 of deck sheet 8 at an obtuse angle and may meet planar top surface 10 of deck sheet 8 at an acute angle. The bevel may, for example, be approximately 3 degrees from vertical.

A non-porous seal member 18 may be glued to deck sheet edge 16. Seal member 18 may be rigid and maybe made of heat formed CORIAN™ brand solid surface material (methylmethacrylate polymer and alumina trihydrate filler). Seal member 18 may have a planar top surface 20 and a planar bottom surface 22.

Outer peripheral surface 15 of seal member 18 may be bevelled to match the bevel of cross-sectional edge 16, for example by 3 degrees from vertical. Top surface 20 and bottom surface 22 of seal member 18 may be flush with top surface 10 and bottom surface 12 of deck sheet 8, as shown in FIGS. 1 and 3.

As shown in FIG. 1, countertop laminate 24 may be bonded to top surface 10 of deck sheet 8 and bonded to a portion of top surface 20 of seal member 18, providing a seal across the top of cross-sectional edge 16. Clamps 30 may be used to affix undermount sink 32 to the underside of mounting unit 6. Clamps 30 may comprise clamp member 29 and securing means (such as a screw or bolt) 31 secured to deck sheet 8 for biasing plate 29 against sink flange 36. Clamp member 29 may be made of a relatively rigid resilient material such as steel, and may take the form of individual clips positioned at various locations around flange 36, or a complete annulus engaging the whole flange 36. By securing clamps 30 to deck sheet 8, the weight of sink 32 is born by deck sheet 8 and not by seal member 18.

Figure 4:
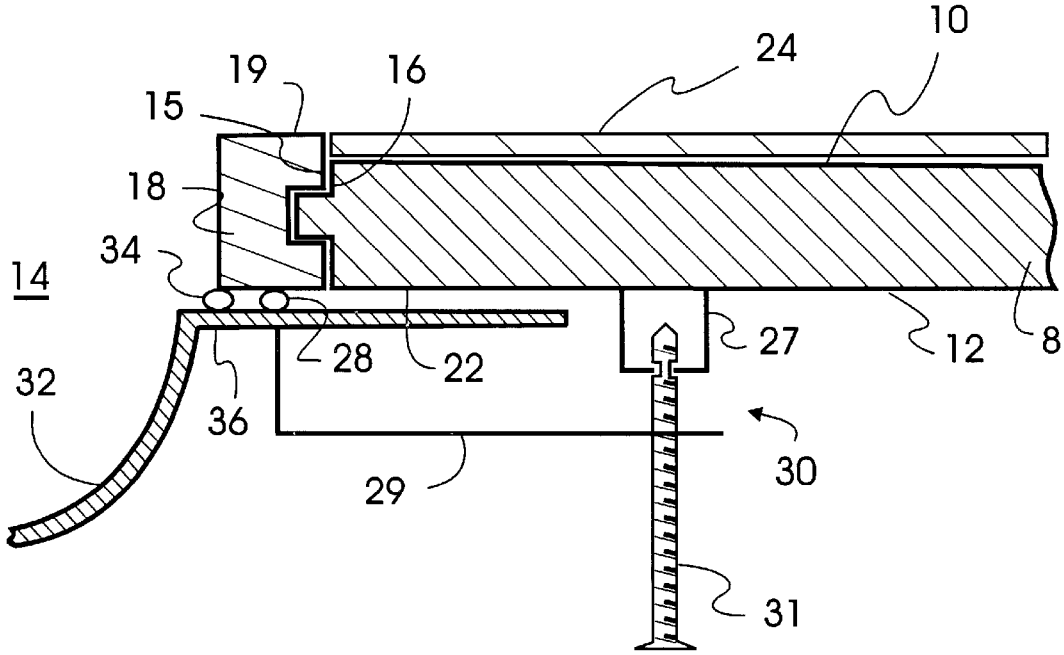
FIG. 4 is a partially fragmented, partially exploded, cross-sectional view of the mounting unit, showing an undermount sink and a laminated countertop, in which the sink is being biased towards the deck.

Gasket 28 seated in groove 26 in bottom surface 22 of seal member 18 may be deformable so that it may be compressed by sink flange 36 when clamp 30 is secured to deck sheet 8 by securing means 31. Resiliently deformable materials such as rubber, for example silicone rubber, may be used as gasket material in some embodiments. Functionally equivalent gasket materials are widely available in the art for use with the invention. Gasket 28 on the bottom surface 22 of seal member 18 may be applied to bottom surface 22 or seal member 18 as a bead of hardenable gasket material, obviating the need for groove 26, as shown in FIGS. 3 and 4. Clamp 30 may be tightened to bias flange 36 against seal member 18 to seal the engagement between flange 36 and seal member 18 by compressing gasket 28, the compression being limited by the engagement of flange 36 with a stopping surface such as bottom surface 12 of deck sheet 8 (see FIGS. 1, 3, 4, 5, 7, 8 or 9) or bottom surface 22 of seal member 18 (where the seal member 18 is adapted to transmit the biasing force to the bottom surface 12 of deck sheet 8; see FIGS. 6 and 10).

A bevel on cross-sectional edge 16 of deck sheet 8 may help to ensure that seal member 18 is not displaced by an applied biasing force when clamp 30 is secured. Beads of silicone sealant 34, or equivalents thereof, may be used to help seal peripheral sink flange 36 to bottom surface 22 of seal member 18. A wide variety of water-resistant resiliently flexible adhesives may be used in this manner, as is known in the plumbing art for sealing and affixing sinks to countertops.

To manufacture apertured mounting unit 6, aperture 14 may be cut in deck sheet 8, forming cross-sectional edge 16. If deck sheet 8 is comprised of wood fibre board, as is often the case in commercial laminated countertops, cross-sectional edge 16 of deck sheet 8 may be relatively porous. Other deck sheet materials, such as plaster board, that could be used in alternative embodiments of the invention are also porous and susceptible to water damage.

A rigid, non-porous seal member 18, having top surface 20 and bottom surface 22 may be formed for installation in deck sheet 8. Seal member 18 is dimensioned to fit inside aperture 14 and abut cross-sectional edge 16. Seal member 18 may be inserted into aperture 14 in abutment with cross-sectional edge 16, and may be glued into place against edge 16. Top surface 20 and bottom surface 22 of seal member 18 may be coplanar with adjacent top surface 10 and bottom surface 12 of deck sheet 8.

Seal member 18 may be formed by cutting two strips of appropriately dimensioned seal member material from CORIAN™ brand sheet stock. The strips of seal member material may then be heated to a temperature at which the strips are deformable, 315° F.–330° F., 15 to 20 minutes of heating being suitable for some ⅝"×½" strips of CORIAN™ brand material. The strips of seal member material may then be molded, each to an appropriate shape to fit against a portion of deck sheet edge 16, and allowed to cool. The molded strips may then be bonded together, by methods known in the solid surface fabrication art, to form complete seal member 18. Groove 26 may be cut in bottom surface 22 of seal member 18. Resilient gasket 28 may then be sealably seated in groove 26, Alternatively, gasket 28 may be applied to bottom surface 22 of seal member 18 as a bead of hardenable liquid which adheres to bottom surface 22, in which case groove 26 may not be necessary.

To install mounting unit 6 in a countertop, top surface 10 and bottom surface 12 of deck sheet 8 may be aligned respectively with the top and bottom surfaces of an adjacent countertop core sheeting. Once mounting unit 6 is affixed adjacent to the remaining countertop core, the entire top surface of the countertop, including top surface 10 of deck sheet 8 and top surface 20 of seal member 18 may be laminated.

Once mounting unit 6 is installed, utility member 32, such as an undermount sink 32, may be mounted to the bottom surface 12 of deck sheet 8. In affixing utility member 32 to bottom surface 22 of seal member 18, beads of silicone sealant 34 may be applied to bottom surface 22 of seal member 18. Clamps 30 may be used to affix undermount sink 32 to the underside of mounting unit 6.

Seal member 18 may be installed in an existing, previously laminated, countertop in a number of ways (the countertop comprising deck sheet 8 covered by laminate 24). A hole may first be cut in the laminated countertop (a hole may already be present if, for example, a drop-in sink has previously been installed in the countertop).

To install ring 18 in a previously laminated countertop, the laminated countertop may be turned upside-down and a router used to remove an annular portion of deck sheet 8 from beneath the laminate 24 around the periphery of the hole in the countertop, to form aperture 14. It may be convenient, especially if the laminated countertop is a cove-top design, to use a spacer (such as a sheet of plywood) between the bottom of the countertop and the router, so that the configuration of the countertop bottom does not interfere with the path traveled by the router (otherwise, in some cove-top countertop designs in particular, the router may be blocked from the required path of travel by the downwardly depending front edge of the countertop). As an alternative to operating the router on the bottom side of deck sheet 8, the router may be used from the top side of the countertop and set to undercut laminate 24. If the router is to be operated by hand, whether the router is used from the top side or the bottom side of the laminated countertop, the router may be guided by a guiding template, with a cut-out within which the router travels. Alternatively, an automated router may be programmed with appropriate cutting coordinates, so that no template is required.

When installing ring 18 in a countertop which has already been laminated, to avoid damaging laminate 24, the router may be adjusted, at least on the first pass, to leave a portion of deck sheet 8 attached to the underside of laminate 24 around the periphery of the hole in the countertop. The router may then be recalibrated and used again to remove another annular portion of deck sheet 8 from the underside of laminate 24. Portions of deck sheet 8 remaining on the underside of the annular, under-cut portion of laminate 24 may also be removed with a chisel or similar tool if desired. A thin portion of deck sheet material that may remain beneath the under-cut portion of laminate 24, may be treated with a penetrating compound that sets to render such deck sheet material generally impervious to water.

Once an annular portion of deck sheet 8 has been removed from the periphery of the hole in the laminated countertop, deck sheet 8 defines aperture 14. Ring 18 may then be installed beneath the annular, under-cut portion of laminate 24, so that bottom planar surface 22 of ring 18 may be coplanar with bottom surface 12 of deck sheet 8. Ring 18 may be attached to the underside of laminate 24 by adhesive, such as contact cement or silicone adhesive (or alternatives such as the adhesive LOCKWELD 8215™, which may be available from Wilsonart International of Temple, Tex.) or equivalents thereof. Similar adhesives may also be used to affix ring 18 to cross-sectional edge 16 of deck sheet 8.

Ring 18 may be installed as part of the process of making laminated countertops on a large scale, such as commercial processes for producing cove-top countertops. In accordance with this embodiment of the invention, it will be appreciated that deck sheet 8 may be provided in a variety of shapes and sizes, such as the common cove-top configuration with an upwardly projecting backsplash portion at the rear of the countertop and a downwardly depending lip at the front of the countertop. To manufacture a section of countertop which includes ring 18, aperture 14 may be cut in deck sheet 8 and ring 18 installed in the aperture as discussed above. Top surface 10 of deck sheet 8 with attached ring 18 may then be laminated, so that top surface 20 of ring 18 is covered by laminate 24; aperture 14 may also be covered by laminate 24. The portion of laminate 24 overlying aperture 14 may then be removed, to expose aperture 14, with ring 18 around the periphery of aperture 14.

Seal member 18 may be preinstalled on upper circumferential flange 36 of a sink or other utility member 32 using an appropriate adhesive that removably or releasably couples seal member 18 to sink 32, such as silicone adhesive and equivalents thereof. Sinks 32 provided with such seal members 18 may be fitted to apertured countertops dimensioned using templates to receive the ring with the aperture when the flange abuts a stopping surface, such as bottom surface 12 of deck sheet 8.

Embodiments of seal member 18 may be adapted for use with tile countertops, as shown in FIG. 3. In such an embodiment, seal member 18 may comprise a generally planar top surface 20 that is generally coplanar with the top surface 10 of deck sheet 8. The top of raised portion 21 of seal member 18 adjacent to aperture 14 may be generally coplanar with the top surface of tiles 25. Tiles 25 rest on planar top surface 20 of seal member 18 and planar top surface 10 of deck sheet 8, preferably spanning the joint between seal member 18 and deck sheet 8, and abutting raised portion 21 of seal member 18.

Seal member 18 as shown in FIG. 3 with raised portion 21 may also be adapted for use with traditional laminate countertops or SSV laminated countertops, instead of a tile countertop. In such an embodiment, the top of raised portion 21 may be dimensioned to be generally coplanar with the top surface of the laminate and the laminate may be sealably attached to planar top surface 20 of seal member 18.

As shown in FIG. 4, seal member 18 may be made with an indentation in outer peripheral surface 15. In this embodiment, it may be convenient to make seal member 18 out of extruded plastic, the extrusion having the appropriate profile. The profile of cross-sectional edge 16 may be adapted, for example by use of a suitable router bit, to mate with the profile of seal member 18, so that seal member 18 and deck sheet 8 mate when jointed. In accordance with this embodiment, outer peripheral surface 15 of seal member 18 may of course be provided with a wide range of indentations or extensions and cross-sectional edge 16 profiled correspondingly to mate with seal member 18.

As shown in FIG. 3, outer peripheral surface of seal member 18 may be provided with a protrusion 33 (which may be a pliable circumferential protrusion, such as an O-ring, which may be seated in a groove or applied as a bead of hardenable liquid). The surface of cross-sectional edge 16 may be provided with an indentation that is adapted to mate with protrusion 33 on seal member 18. With this construction, seal member 18 may "snap" into place in aperture 14. For example, when seal member 18 is pressed into aperture 14, a pliable circumferential protrusion 33 may first be compressed and then expand when it reaches the matching indentation in cross-sectional edge 16. Protrusion 33 on seal member 18 may be useful to hold seal member 18 in place relative to deck sheet 8 while adhesive sets. Providing protrusion 33 on seal member 18 may make it possible in joining seal member 18 to deck sheet 8 to avoid the use of clamps and to use different types of adhesive (adhesives that set more quickly, for example).

As shown in FIG. 4, a top surface 19 of seal member 18 may project above top surface 10 of deck sheet 8. This embodiment of the invention may be useful, for example, for use with tile countertops. Tiles (not shown in FIG. 4) or laminate 24 may abut outer peripheral surface 15 of seal member 18. In one such embodiment, seal member 18 and laminate 24 may be comprised of bondable solid surface material (such as the solid surface laminate material called "Wilsonart Solid Surfacing Veneer" or "SSV" and the ring materials FORMSTONE™ or GIBRALTAR™, which materials may be manufactured by Aristech Chemical Corp. of Florence, Ky. and may be available from Wilsonart International of Temple, Tex.), in which case catalyzed bonding adhesive may be used to join laminate 24 to seal member 18. The sealed joint between laminate 24 and seal member 18 may help prevent liquids from seeping into deck sheet 8. Similarly, in a tile countertop, grout may be used to seal the junction between tile 25 and seal member 18.

Clamps 30 may be used as means for removably supporting utility member 32 on bottom surface 12 of deck sheet 8. As shown in FIGS. 3 and 4, clamp 30 may comprise bracket 27 affixed to bottom surface 12 of deck sheet 8. Screw 31 rotatably engages bracket 27. Plate 29 is threadably received on screw 31, so that rotation of screw 31 causes plate 29 to move up or down. Plate 29 may be biased against flange 36 by rotating screw 31, applying a biasing force towards the bottom surface 12 of deck sheet 8 to bring flange 36 into sealable engagement with bottom surface 22 of seal member 18 as bottom surface 12 of deck sheet 8 acts as a stopping surface to prevent further upward movement of flange 36.

Figure 5:
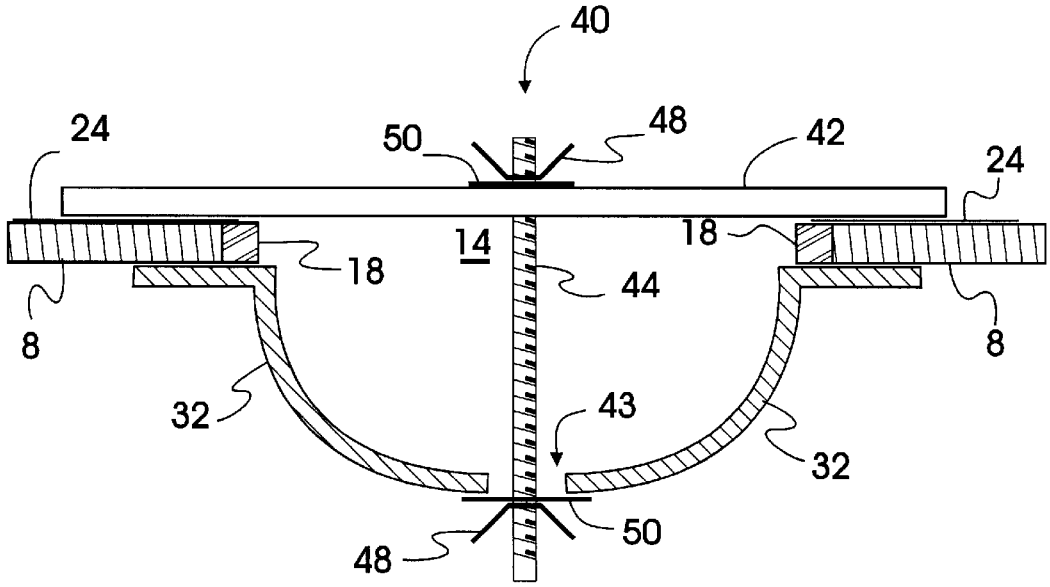
FIG. 5 is a partially fragmented, partially exploded, cross-sectional view of the mounting unit, showing an undermount sink being biased towards the deck sheet with a hanging tool.

As shown in FIG. 5, to install utility member 32, such as an undermount sink, it may be useful to use hanging tool 40 that holds sink 32 in place from above aperture 14. Board 42 may be provided sparing aperture 14. Threaded member 44 may be passed through a hole (not shown) in board 42. Threaded member 44 depends downwardly from board 42 through the drain hole 43 in sink 32. Nuts 48 and washers 50 of appropriate dimension may used at either end of treaded member 44 to hold sink 32 suspended from board 42. Sink 32 may be raised into position towards the bottom surface 22 of seal member 18 by adjusting nuts 48 on threaded member 44. An adhesive, such as silicone, may be applied to removably hold sink 32 in engagement with the bottom surface of deck sheet 8. Alternatively, clamps or other fasteners (not shown in FIG. 5) may be used to removably hold sink 32 in engagement with deck sheet 8.

Figure 6:
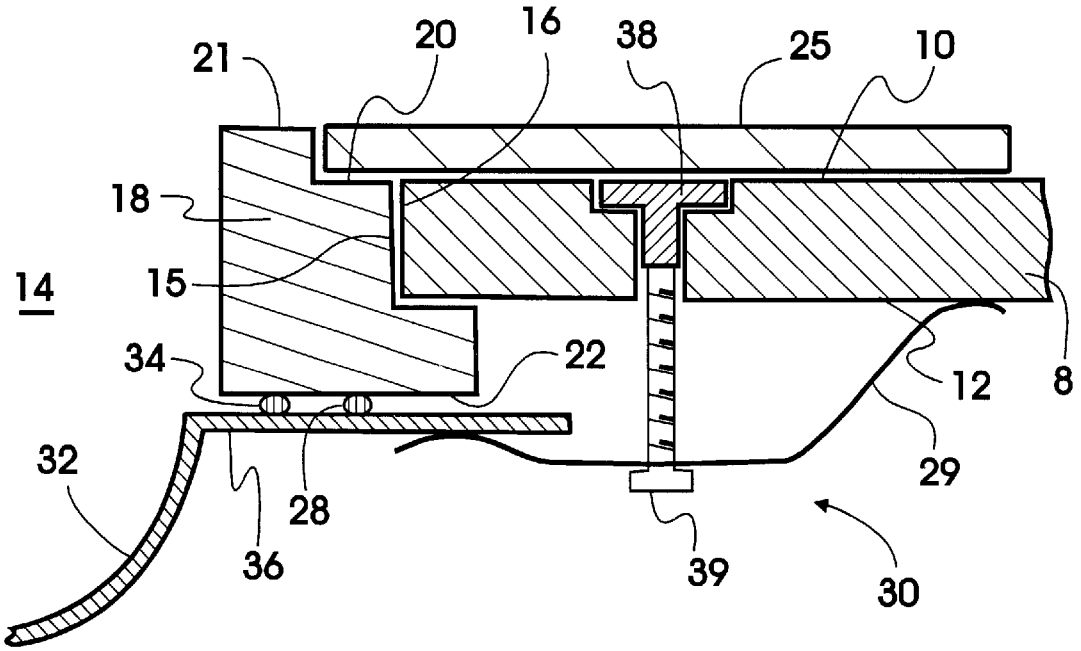
FIG. 6 is a partially fragmented, partially exploded, cross-sectional view, showing alternative embodiments of the seal member and the clamp for holding the sink to the deck sheet.

As shown in FIG. 6, sink flange 36 may be releasably or removably held against bottom surface 22 of seal member 18 using clamp 30 comprising threaded fastener 39 received in flanged nut 38. Flanged nut 38 is housed in a countersunk bore in deck sheet 8 to prevent threaded fastener 39 from moving downwardly with respect to deck sheet 8. The top surface of flanged nut 38 may be made flush with top surface 10 of deck sheet 8, so that tile 25 (or laminate or solid surface veneer) may rest on the top surface of flanged nut 38. The combination of flanged nut 38 and threaded fastener 39 may be replaced by bolt (not shown) that is fixed in deck sheet 8 to receive a nut that is adjustable to bias clamping member 29 against flange 36. However, in some embodiments it may be desirable to install nut 38 in deck sheet 8 without a threaded fastener 39.

FIG. 6 shows seal member 18 in a stepped L-shape, with a horizontal portion of seal member 18 extending below bottom surface 12 of deck sheet 8. In such an embodiment, bottom surface 22 of seal member 18 acts as a stopping surface against which sink flange 36 may be biased by clamp 30, thereby communicating the biasing force to bottom surface 12 of deck sheet 8. Seal member 18 is accordingly prevented from being forced upwardly out of aperture 14 by the biasing force of clamp 30.

Figure 7:
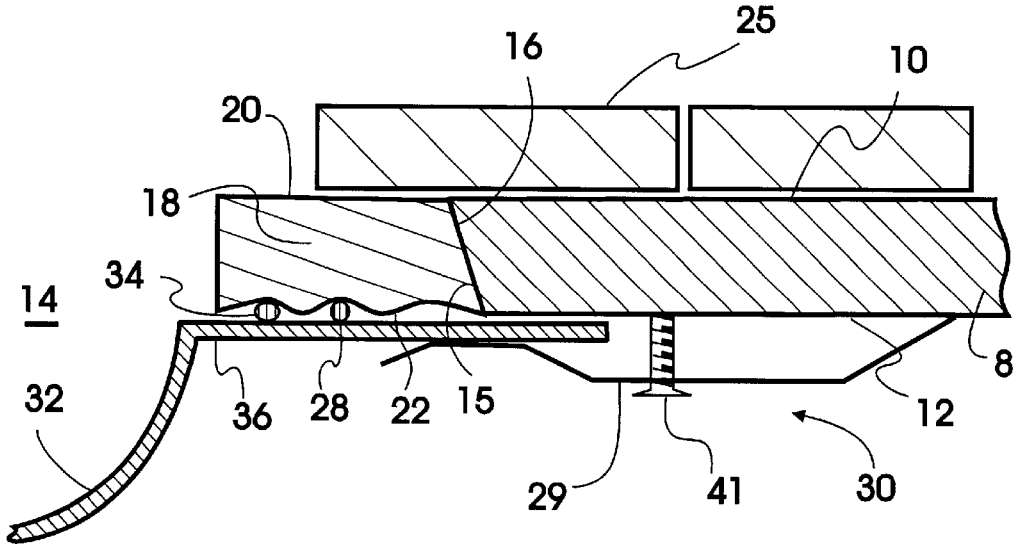
FIG. 7 is a partially fragmented, partially exploded, cross-sectional view, showing further alternative embodiments of the seal member and the clamp for holding the sink to the deck sheet.

FIG. 7 shows an alternative embodiment, with profiled seal member 18 bottom surface 22 having undulations. The undulations may house gasket 28 and adhesive/sealant 34. Bottom surface 22 of seal member 18 may be dimensioned in a wide variety of formats, provided bottom surface 22 is adapted to be sealingly engaged to sink flange 36. A variety of sealants and gaskets may be used between bottom surface 22 of seal member 18 and sink flange 36 in order to provide for such engagement. In some embodiments, the lower extremities of a profiled seal member 18 bottom surface 22 may lie on a plane, in effect making the bottom surface 22 functionally planar. In some embodiments, as shown in FIG. 7, such lower extremities may be coplanar with bottom surface 12 of deck sheet 8. In alternative embodiments, a profiled seal member 18 bottom surface 22 may be above or below the plane of the bottom surface 12 of deck sheet 8, as would be the case in appropriately adapted versions of the embodiments shown in FIGS. 6, 8, 9 and 10.

Preferably, any materials used to join seal member 18 to sink flange 36 are resiliently flexible. Such materials may help to isolate stresses applied to the sink, so that such stresses are not communicated to seal member 18 and thence to the important sealed joint between seal member 18 and laminate 24 or other countertop material. Vibrational stresses, for example from in-sink waste disposal mechanisms, may be dampened by such resiliently flexible materials.

FIG. 7 shows an alternative structure for clamp 30, in which a screw 31 is received by clamp member 29. Screw 31 biases clamp member 29 against bottom surface 12 of deck sheet 8 and against sink flange 36. Bottom surface 12 of deck sheet 8 acts as a stopping surface against which sink flange 36 abuts, communicating the biasing force to bottom surface 12 of deck sheet 8, thereby limiting the upward travel of sink flange 36 to avoid placing undue stress on seal member 18 (which would in turn stress the engagements between seal member 18 and tile 25 and between seal member 18 and deck sheet 8).

Figure 8:
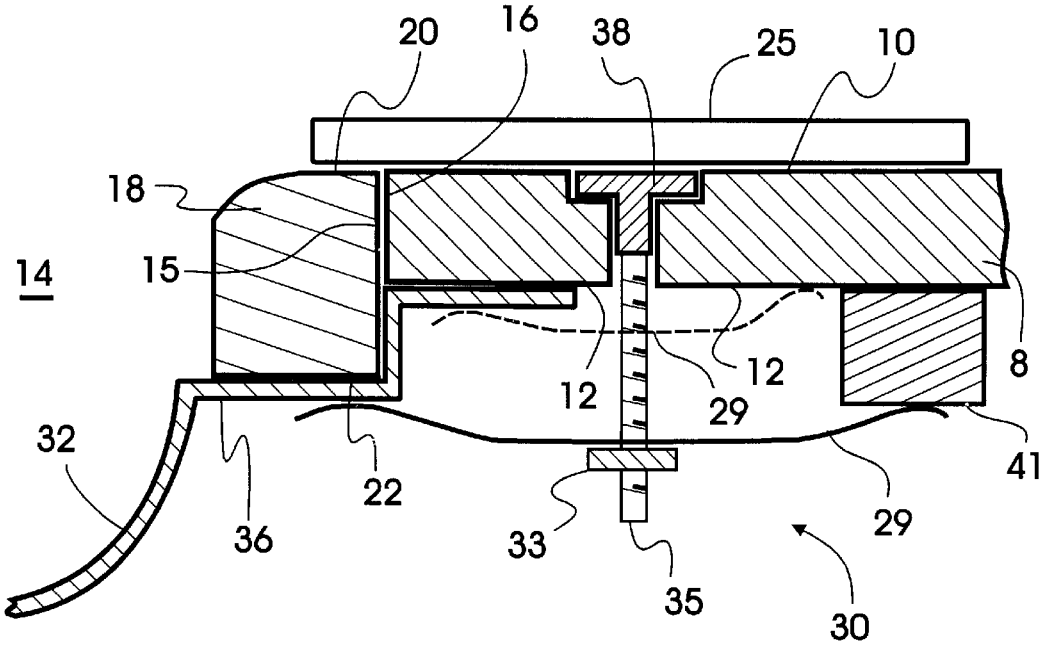
FIG. 8 is a partially fragmented, partially exploded, cross-sectional view, showing further alternative embodiments of the seal member and the clamp for holding the sink to the deck sheet, with one alternative clamp member shown by a dashed line.
Figure 9:
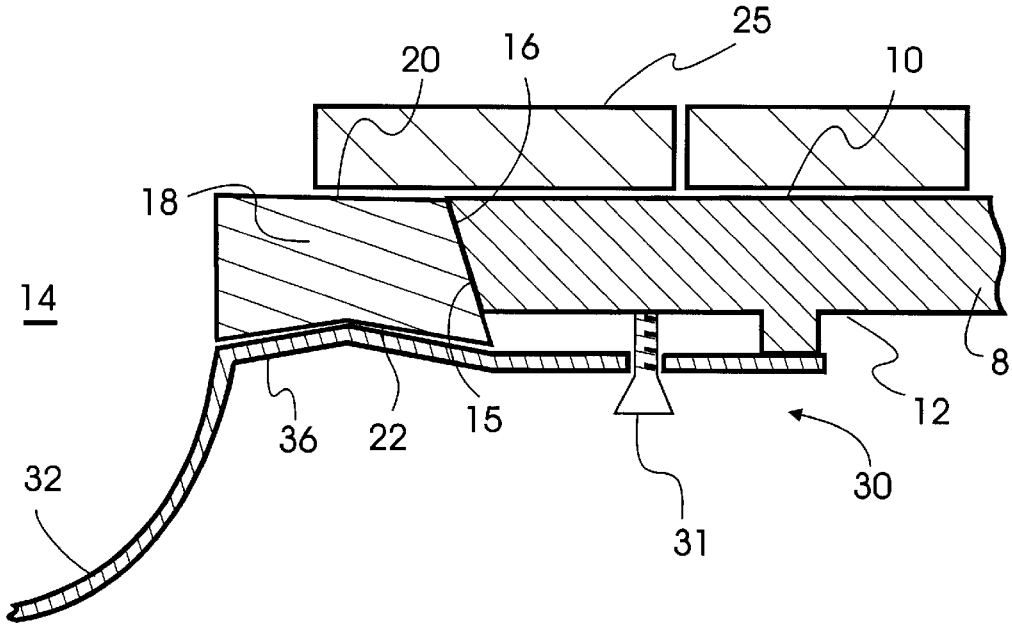
FIG. 9 is a partially fragmented, partially exploded, cross-sectional view, showing further alternative embodiments of the seal member, the clamp for holding the sink to the deck sheet, and the sink flange.

FIG. 8 shows an alternative embodiment of clamp 30, in which threaded rod 31 adjustably connects flanged nut 38 and nut 33, so that clamp member 29 may be biased against sink flange 36 and spacer 41. Spacer 41 may be made of wood or any other suitable rigid material and fastened to deck sheet 8, or it may simply be held in place by clamp 30. Alternatively, a spacer may be integral to deck sheet 8, as shown in FIG. 9.

In alternative embodiments (not shown) spacer 41 may be placed adjacent to seal member 18, so that the bottom surface of spacer 41 may be generally coplanar with bottom surface 22 of seal member 18. In such an embodiment, spacer 41 in effect merely acts as an extension of bottom surface 12 of deck sheet 8, facilitating the use of alternative seal members and alternative means for releasably or removably holding the sink to the deck sheet.

As shown in FIG. 8, sink flange 36 may be profiled for sealing engagement with bottom surface 22 of seal member 18 at the same time as abutting bottom surface 12 of deck sheet 8. In such an embodiment, bottom surface 12 of deck sheet 8 acts as a stopping surface engaging sink flange 36 to communicate the biasing force exerted by screw 31 to bottom surface 12 of deck sheet 8 as sink flange 36 is brought into sealable engagement with bottom surface 22 of seal member 18.

FIG. 8 shows alternative clamp member 29 as a dashed line. Such an embodiment of clamp 30 would not require the use of spacer 41.

FIG. 9 shows an alternative clamp 30, comprising screw 31 accommodated by a hole in sink flange 36. Screw 31 (or another fastener such as a nail) biases sink flange 36 against bottom surface 12 of deck sheet 8, where bottom surface 12 is extended downwardly to provide a spacer portion adapted to abut flange 36. Sink flange 36 of FIG. 9 is profiled to mate with similarly profiled bottom surface 22 of seal member 18. A wide range of matable profiles may be provided on sink flanges and seal members, although this would typically involve custom making sinks for use with a particular seal member. Alternatively, a spacer member (not shown) may be made to fit between seal member 18 bottom surface 22 and flange 36, the spacer member being profiled and shaped to mate on its upper portion with bottom surface 22 of seal member 18 and to mate on its lower portion with flange 36.

In the embodiment of FIG. 9, the stopping surface comprises both the downwardly extended portion of lower surface 12 of deck sheet 8, as well as lower surface 22 of seal member 18. The biasing force of screw 31 against flange 36 being communicated partly by seal member 18 to the beveled portion of deck sheet cross-sectional edge 16.

Figure 10:
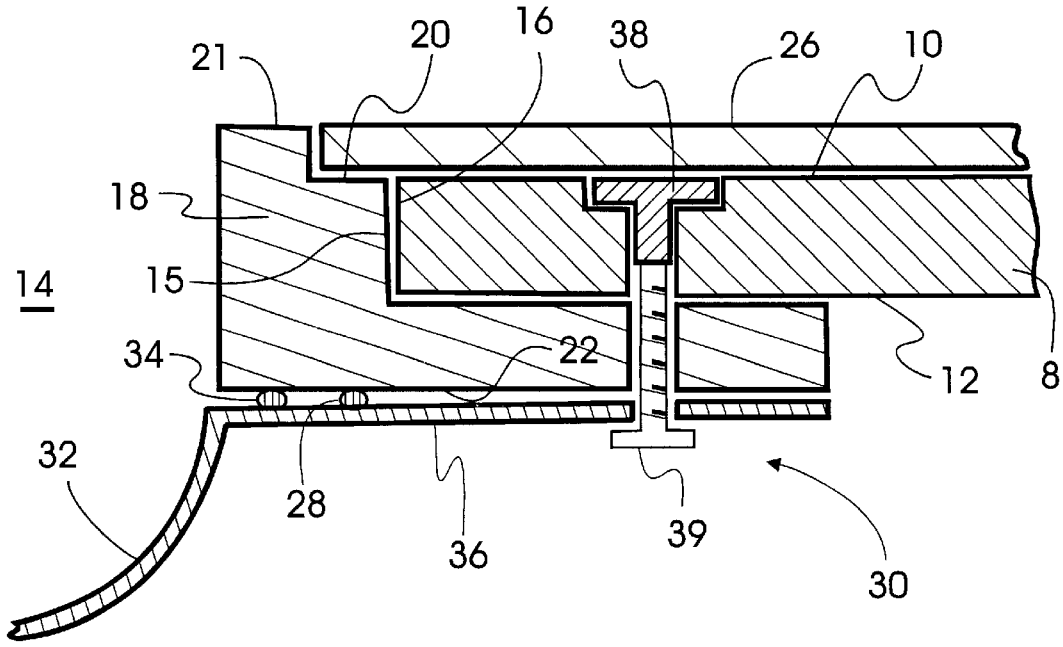
FIG. 10 is a partially fragmented, partially exploded, cross-sectional view, showing further alternative embodiments of the seal member, the clamp for holding the sink to the deck sheet and the sink flange.

FIG. 10 shows an alternative clamp 30 arrangement, in which bolt 39 is threadably received by flanged nut 38 providing a fastener that may be adjusted to bias sink flange 36 against bottom surface 22 of seal member 18. Bolt 39 is accommodated by a hole in sink flange 36 and passes through a bore in seal member 18 and a bore countersunk in top surface 10 of deck sheet 8. The biasing force exerted by bolt 39 against sink flange 36 is communicated to bottom surface 12 of deck sheet 8, so that bottom surface 22 of seal member 18 acts as a stopping surface to limit the upward travel of sink flange 36.

In FIG. 10, solid surface veneer (SSV) material 26 is sealed over top of flanged nut 38 after the nut is installed in the countersunk bore in deck sheet 8. The SSV may be made of the same material as seal member 18, allowing a virtually invisible bond to be formed between SSV and seal member 18 using an appropriate solid surfacing adhesive, as are well known in the art.

Typically, the bottom surface of the deck sheet will be planar. Those skilled in this art will understand that the invention may be adapted to a wide variety of deck sheet bottom configurations, provided the flange is biased towards the deck sheet bottom and a stop fixed with respect to the deck sheet bottom surface cooperates with the flange to prevent the flange from moving beyond the point of sealing engagement with the seal member.

As will be apparent to those skilled in the art in the light of the foregoing disclosure, many alterations and modifications are possible in the practice of this invention without departing from the spirit or scope thereof. For example, the mounting unit according to the invention may be used with a variety of fixtures or utility members, other than sinks, such as cutting boards, tubs, waste and recycling bins, even fish tank lids or port holes. Similarly, a wide variety of fasteners, such as specialized clamps, are known to those skilled in the art as means for removably supporting an undermount sink. Such mechanisms and their present and future equivalents are encompassed by various aspects of the present invention. Accordingly, the scope of the invention is to be construed in accordance with the substance defined by the following claims.

What is claimed is:

1. A method of manufacturing an apertured mounting unit comprising the steps of:

a) providing a porous deck sheet having a top surface and a bottom surface;

b) cutting the deck sheet to form a porous cross-sectional edge in the deck sheet defining an aperture and profiling the cross-sectional edge so that in a profiled portion of the cross-sectional edge an upper segment of the cross-sectional edge projects further into the aperture than a lower segment of the cross-sectional edge, such that the profiled portion of the cross-sectional edge restricts the upward movement of the seal member with respect to the deck sheet;

c) forming a non-porous seal member having a top surface and a bottom surface, the seal member being dimensioned to fit inside the aperture and abut the cross-sectional edge of the deck sheet, wherein the seal member comprises a solid surface material selected from the group consisting of polyester resins; acrylic resins; cast acrylic resins with inert fillers; mineral filled polyester resins; mineral filled acrylic resins; methylmethacrylate polymers with alumina trihydrate fillers; and, homogeneous, thermoset polymer alloys comprised of polyester and acrylic components and filled with aluminium trihydrate, wherein the step of forming the non-porous seal member comprises:

i) cutting a strip of appropriately dimensioned seal member material from sheet stock, so that the strip has two ends;

ii) heating the strip of seal member material to a temperature at which the strip is deformable;

iii) molding the heated strip to an appropriate shape to fit against the cross-sectional edge of the deck sheet edge; and iv) bonding the two ends of the strip of seal member material together to form the seal member;

d) inserting the seal member into the aperture in abutment with the cross-sectional edge of the deck sheet;

e) providing a utility member with an outwardly extending circumferential flange; and, f) removably fastening the utillity member to the deck sheet by applying a biasing force to bias the upper circumferential flange of the utility member into sealable engagement with the bottom surface of the seal member as the upper circumferential flange is biased against a stopping surface that is fixed with respect to the bottom surface of the deck sheet, the stopping surface communicating the biasing force to the bottom surface of the deck sheet.

2. The method of claim 1 wherein a portion of the bottom surface of the deck sheet adjacent to the seal member is generally planar and a portion of the bottom surface of the seal member adjacent to the deck sheet is generally planar, and the generally planar portions of the bottom surfaces of the deck sheet and the seal member are generally coplanar.

3. The method of claim 2 further comprising the step of bonding a laminate sheet to the top surface of the deck sheet and to the top surface of the seal member.

4. The method of claim 2 wherein the a portion of the top surface of the deck sheet adjacent to the seal member is generally planar and a portion of the top surface of the seal member adjacent to the deck sheet is generally planar, and the generally planar portions of the top surfaces of the deck sheet and the seal member are generally coplanar.

5. The method of claim 4 further comprising the step of bonding a laminate sheet to the top surface of the deck sheet and to the top surface of the seal member.

6. The method of claim 1 wherein the a portion of the top surface of the deck sheet adjacent to the seal member is generally planar and a portion of the top surface of the seal member adjacent to the deck sheet is generally planar, and the generally planar portions of the top surfaces of the deck sheet and the seal member are generally coplanar.

7. The method of claim 6 further comprising the step of bonding a laminate sheet to the top surface of the deck sheet and to the top surface of the seal member.

8. The method of claim 1 further comprising the step of bonding a laminate sheet to the top surface of the deck sheet and to the top surface of the seal member.

9. The method of claim 1, further comprising the additional step of providing a resilient gasket in sealable engagement with the bottom surface of the seal member.

10. The method of claim 9 further comprising the step of bonding a laminate sheet to the top surface of the deck sheet and to the top surface of the seal member.

11. A method of manufacturing an apertured mounting unit comprising the steps of:

a) providing a porous deck sheet having a top surface and a bottom surface;

b) cutting the deck sheet to form a porous cross-sectional edge in the deck sheet defining an aperture;

c) forming a non-porous seal member having a top surface and a bottom surface, the seal member being dimensioned to fit inside the aperture and abut the cross-sectional edge of the deck sheet;

d) forming a channel in the bottom surface of the seal member and seating a gasket in the channel;

e) inserting the seal member into the aperture in abutment with the cross-sectional edge of the deck sheet;

f) providing a utility member with an outwardly extending circumferential flange; and, g) removably fastening the utillity member to the deck sheet by applying a biasing force to bias the upper circumferential flange of the utility member into sealable engagement with the bottom surface of the seal member as the upper circumferential flange is biased against a stopping surface that is fixed with respect to the bottom surface of the deck sheet, the stopping surface communicating the biasing force to the bottom surface of the deck sheet.

12. The method of claim 11, wherein the seal member comprises a solid surface material selected from the group consisting of polyester resins; acrylic resins; cast acrylic resins with inert fillers; mineral filled polyester resins; mineral filled acrylic resins; methylmethacrylate polymers with alumina trihydrate fillers; and, homogeneous, thermoset polymer alloys comprised of polyester and acrylic componets and filled with aluminium trihydrate.

13. The method of claim 12 further comprising the step of bonding a laminate sheet to the top surface of the deck sheet and to the top surface of the seal member.

14. The method of claim 11, further comprising the step of profiling the cross-sectional edge so that in a profiled portion of the cross-sectional edge an upper segment of the cross-sectional edge projects further into the aperture than a lower segment of the cross-sectional edge, such that the profiled portion of the cross-sectional edge restricts the upward movement of the seal member with respect to the deck sheet.

15. The method of claim 14 further comprising the step of bonding a laminate sheet to the top surface of the deck sheet and to the top surface of the seal member.

16. The method of claim 14, wherein the seal member comprises a solid surface material selected from the group consisting of polyester resins; acrylic resins; cast acrylic resins with inert fillers; mineral filled polyester resins; mineral filled acrylic resins; methylmethacrylate polymers with alumina trihydrate fillers; and, homogeneous, thermoset polymer alloys comprised of polyester and acrylic components and filled with aluminium trihydrate.

17. The method of claim 16 further comprising the step of bonding a laminate sheet to the top surface of the deck sheet and to the top surface of the seal member.

18. The method of claim 11 further comprising the step of bonding a laminate sheet to the top surface of the deck sheet and to the top surface of the seal member.

19. The method of claim 11 wherein a portion of the bottom surface of the deck sheet adjacent to the seal member is generally planar and a portion of the bottom surface of the seal member adjacent to the deck sheet is generally planar, and the generally planar portions of the bottom surfaces of the deck sheet and the seal member are generally coplanar.

20. The method of claim 11 wherein the a portion of the top surface of the deck sheet adjacent to the seal member is generally planar and a portion of the top surface of the seal member adjacent to the deck sheet is generally planar, and the generally planar portions of the top surfaces of the deck sheet and the seal member are generally coplanar.

21. The method of claim 20 wherein a portion of the bottom surface of the deck sheet adjacent to the seal member is generally planar and a portion of the bottom surface of the seal member adjacent to the deck sheet is generally planar, and the generally planar portions of the bottom surfaces of the deck sheet and the seal member are generally coplanar.

22. The method of claim 21 further comprising the step of bonding a laminate sheet to the top surface of the deck sheet and to the top surface of the seal member.

* * * * *